US011024478B2

(12) United States Patent
I

(10) Patent No.: US 11,024,478 B2
(45) Date of Patent: Jun. 1, 2021

(54) OVERHEATING DESTRUCTIVE DISCONNECTING METHOD FOR SWITCH

(71) Applicant: GREEN IDEA TECH INC., Mahe (SC)

(72) Inventor: Hsiang-Yun I, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 0 days.

(21) Appl. No.: 16/233,084

(22) Filed: Dec. 27, 2018

(65) Prior Publication Data

US 2020/0105486 A1 Apr. 2, 2020

(30) Foreign Application Priority Data

Oct. 2, 2018 (TW) ..... 107134827

(51) Int. Cl.
*H01H 37/32* (2006.01)
*H01R 13/70* (2006.01)
(Continued)

(52) U.S. Cl.
CPC ..... *H01H 37/32* (2013.01); *H01H 13/20* (2013.01); *H01H 37/76* (2013.01); *H01H 85/08* (2013.01); *H01R 13/70* (2013.01)

(58) Field of Classification Search
CPC ..... H01H 37/32; H01H 37/76; H01H 85/08; H01H 13/20; H01R 13/70
(Continued)

(56) References Cited

U.S. PATENT DOCUMENTS 5,694,106 A * 12/1997 Wang ..... H01H 71/16 337/79
6,940,389 B1 * 9/2005 Yu ..... H01H 73/26 337/59
(Continued)

FOREIGN PATENT DOCUMENTS

CN 103441019 B 10/2015
TW 321352 11/1997
(Continued)

*Primary Examiner* — Jayprakash N Gandhi
*Assistant Examiner* — Stephen S Sul
(74) *Attorney, Agent, or Firm* — Michael D. Eisenberg

(57) ABSTRACT

An overheating destructive disconnecting method for switch, which enables a first elastic force to concurrently apply force to an overheating destructive member and a movable conductive member. Moreover, the force direction causes the movable conductive member to concurrently contact a first conductive member and a second conductive member to form a conductive circuit. A second elastic force acts on the movable conductive member, and the force direction thereof causes the movable conductive member to separate away from the first conductive member or the second conductive member, The overheating destructive member is positioned in a required non-electric transmission path and at a distance from the movable conductive member. When the overheating destructive member is destructed or deformed under a fail temperature condition, the first elastic force is lessened or lost, at which time the second elastic force causes the movable conductive member to change position, thereby breaking the current-carrying circuit.

6 Claims, 9 Drawing Sheets

(51) Int. Cl.
*H01H 13/20* (2006.01)
*H01H 37/76* (2006.01)
*H01H 85/08* (2006.01)

(58) Field of Classification Search
USPC ..... 337/14, 36, 37, 52, 53, 56, 59, 85, 91, 337/298, 333, 334, 342, 343, 34, 5, 348
See application file for complete search history.

(56) References Cited

U.S. PATENT DOCUMENTS 7,030,726 B2 * 4/2006 Yu ..... H01H 73/26 337/59
7,202,769 B2 * 4/2007 Yu ..... H01H 73/26 337/37
7,236,082 B2 * 6/2007 Kuo ..... H01H 73/26 337/56
7,248,140 B2 * 7/2007 Yu ..... H01H 71/7436 337/56
7,304,560 B2 * 12/2007 Yu ..... H01H 73/26 337/56
7,688,174 B2 * 3/2010 Hung ..... H01H 23/025 337/56
9,698,542 B1 7/2017 I
9,805,899 B2 * 10/2017 Wang ..... H01H 89/04
10,403,459 B1 * 9/2019 I ..... H01R 13/7137
10,438,762 B1 * 10/2019 I ..... H01H 13/20
2003/0160679 A1 * 8/2003 Yu ..... H01H 71/7427 337/37
2004/0036570 A1 * 2/2004 Yu ..... H01H 73/26 337/59
2004/0037020 A1 * 2/2004 Yu ..... H01H 73/26 361/103
2004/0046635 A1 * 3/2004 Chen ..... H01H 73/26 337/59
2016/0233041 A1 * 8/2016 Wang ..... H01H 61/02
2017/0047180 A1 * 2/2017 Wang ..... H01C 7/12
2017/0148602 A1 * 5/2017 Wang ..... H01H 37/761
2018/0019553 A1 * 1/2018 Yuba ..... H01R 13/70

FOREIGN PATENT DOCUMENTS

TW 560690 11/2003
TW 250403 11/2004
TW 382568 6/2010

* cited by examiner

OVERHEATING DESTRUCTIVE DISCONNECTING METHOD FOR SWITCH

CROSS REFERENCES TO RELATED APPLICATIONS

The present application claims priority from Taiwanese Patent Application Serial Number 107134827, filed Oct. 2, 2018, the disclosure of which is hereby incorporated by reference herein in its entirety.

BACKGROUND OF THE INVENTION

(a) Field of the Invention

The present invention relates to an overheating destructive disconnecting method for switch, and more particularly to a disconnecting method that is distinct from a fuse and different from a bimetallic strip. An overheating destructive member of the present invention is positioned in a "required non-electric transmission path", and does not depend on the passing of current to enforce destruction thereof, but uses heat energy transfer to enforce destruction and cause the switch to cut off power.

(b) Description of the Prior Art

Seesaw switches of the prior art use a control switch to effect back and forth pivot rotation within a specified angle range to control closing or opening a circuit. For example, the prior art structure of a "Spark shielding structure of switch" disclosed in ROC Patent No. 560690 describes a positioning feature when pivot rotating a switch to position the switch at a first position or a second position to form a closed circuit or an open circuit.

As for press switches of the prior art, pressing the press switch enables cycling through controlling the closing or opening of a circuit, wherein the press button uses the reciprocating press-button structure similar to that used in an automatic ball-point pen of the prior art, whereby the press button is positioned at a lower position or an upper position each time the switch press button is pressed, an example of which is described in the prior art structure of a "Push-button switch" disclosed in China Patent No. CN103441019.

In the prior art structure of an "Improved structure of an on-line switch" described in ROC Patent No. 321352, a switch structure is disclosed that is provided with a fuse; however, the fuse is positioned in a "required electric transmission path", and thus the fuse necessarily depends on electric current passing therethrough in order to bring about a protective effect. In particular, only when the power supply is overloaded will the fuse melt and cut off the supply of power. In as much the fuse requires a current to pass through during operation; however, the current must be excessive in order to melt the fuse, hence, a low-melting-point lead-tin alloy or zinc is often used for the fuse, providing the fuse with a relatively large electric resistance and an electric conductivity far lower than that of copper. However, because the fuse is positioned in the "required electric transmission path", there is the problem of wastage of energy.

In the prior art structure of a "Bipolar type auto power off safety switch" described in ROC Patent No. M382568, a bimetallic strip type overload protection switch is disclosed; however, the bimetallic strip must similarly be positioned in the "required electric transmission path", and thus necessarily depends electric current passing therethrough for deformation of the bimetallic strip to occur. More particularly, an overloaded electric current is necessary in order to cause the bimetallic strip to deform and break the circuit, and thus similarly has the problem of wastage of energy.

Nevertheless, apart from current overload causing overheating, taking an extension cord socket as an example, the following situations are all possible scenarios resulting in overheating of any one of the sockets, including:

1. Serious oxidation of the metal pins of the plug, wherein the metal pins have become coated with oxides; thus, when the plug is inserted into a socket, the oxides, having poor conductivity, cause greater electrical resistance, which results in the socket overheating.
2. When inserting the metal pins of a plug into a socket, and the metal pins are not completely inserted, resulting in only partial contact, then the contact areas are too small, which causes the socket to overheat.
3. Metal pins of the plug are deformed or worn out, resulting in incomplete contact when inserted into a socket and the contact areas being too small, which gives rise to the socket overheating.
4. Metal pins of the plug or metal strips of the socket are stained with foreign substances, such as dust or dirt, causing poor electric conductivity, which results in greater electrical resistance and overheating.

The above-described conditions result in a critical drop in the operating temperature in the locality of the socket and the operating temperature in the locality of the overload protection switch.

The inventor of the present invention in an "Assembly and method of plural conductive slots sharing an overheating destructive fixing element" described in U.S. Patent application No. U.S. Pat. No. 9,698,542 disclosed distance of a copper strip and temperature difference experimentation, and from the test results presented in TABLE 2 of the above patent, it can be seen that if the above-described overheated socket is positioned at test position 10 of TABLE 2, and the above-described overload protection switch is positioned at test position 1 of TABLE 2, with a distance of 9 cm between the two positions, then when the socket operating temperature reaches 202.9° C., after 25 minutes, the operating temperature of the overload protection switch is only 110.7° C.; that is, when the distance between the socket and the overload protection switch is 9 cm, and when the operating temperature of the socket has already overheated to a temperature of 202.9° C. with the possibility of accidental combustion, then the bimetallic strip of the overload protection switch is still only at a temperature of 110.7° C., and has not yet reached deformation temperature; thus, the overload protection switch will not automatically trip a power-off.

Because there are many circumstances resulting in socket overheating, and the distance between the socket and the bimetallic strip of the overload protection switch can result in an enormous temperature difference, in order to effectively achieve overheating protection, an overload protection switch bimetallic strip should be installed on each of the plug sockets of the extension cord socket. However, apart from the problem of energy wastage in bimetallic strip type overload protection switches, the cost is also relatively high, thus installing a bimetallic strip on each of the sockets of an extension cord socket will lead to a substantial increase in energy wastage and cost, which goes against it being available to all.

SUMMARY OF THE INVENTION

Based on the above-described reasons, in order to overcome the shortcomings, the present invention provides an overheating destructive disconnecting method for switch, comprising the following steps:

Enabling a first elastic force of a first elastic member to concurrently apply force to an overheating destructive member and a movable conductive member through an operating member, whereby the force application direction of the first elastic force causes the movable conductive member to concurrently contact a first conductive member and a second conductive member to form a conductive circuit; enabling a second elastic force of a second elastic member to act on the movable conductive member through the operating member, whereby the force application direction of the second elastic force causes the movable conductive member to separate away from the first conductive member or the second conductive member; when the movable conductive member is concurrently in contact with the first conductive member and the second conductive member, enabling the overheating destructive member to be positioned in a required non-electric transmission path and for the overheating destructive member to be disposed at a position away from the movable conductive member, accordingly the overheating destructive member positioned in the required non-electric transmission path is able to receive heat energy from the current-carrying circuit; enabling the heat energy in the current-carrying circuit to be successively transferred through the movable conductive member and the first elastic member to the overheating destructive member; when the overheating destructive member receives the heat energy and rises in temperature close to its fail temperature, using the force application of the first elastic force to destruct or deform the overheating destructive member, causing deformation of the first elastic member, which results in the first elastic force acting on the movable conductive member being lessened or lost, whereupon the second elastic force presses and forces the movable conductive member to move position, which causes the movable conductive member to no longer concurrently conduct electricity to the first conductive member and the second conductive member, thus breaking the current-carrying circuit.

Furthermore, the fail temperature of the overheating destructive member lies between 100° C. to 400° C.

Further, the overheating destructive member is made from plastic material, such as thermoplastic plastic or thermoset plastic; or, the overheating destructive member is made from metal or an alloy, primary composition of which comprises more than any two of the metals bismuth, cadmium, tin, lead, dysprosium, or indium. For example, the alloy is a tin-bismuth alloy, or one of or a combination of the following metals cadmium, indium, silver, tin, lead, antimony, or copper are additionally added to tin and bismuth.

Based on the above-described technological characteristics, the present invention is able to achieve the following effects:

1. The overheating destructive member is positioned in a "required non-electric transmission path", and the overheating destructive member is not a required component for electric transmission. Electric conductivity of the overheating destructive member of the present invention is far lower than that of copper, and because the electric current will select the path of least electric resistance provided by a "required electric transmission path", thus, the present invention positions the overheating destructive member in the "required non-electric transmission path", thereby effectively preventing wastage of energy.

2. The method of the present invention is easily applied in existing switches, and will not markedly increase the size of the switch, and has application in known seesaw switches, press switches, etc. Additional cost of installation is extremely small and easily achieved.

3. Because of its small size and low cost, the present invention has application in existing electric appliances, such as application in an extension cord. For example, installing each of the plug sockets of the extension cord with a heat destructive disconnecting switch of the present invention ensures the safety of each set of socket apertures corresponding to each of the switches when in use, and also redresses the high cost of conventional bimetallic strips along with the shortcoming thereof, whereby a plurality of sets of socket apertures are required to jointly use one overload protection switch, which will not protect socket apertures distanced further away from the overload protection switch that are already overheating, resulting in an increase in temperature thereof, but the overload protection switch has still not tripped because the temperature has not yet reached the trip temperature.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

The technology phraseology of the present invention is described as follows. A "required electric transmission path"

points to the required path of electric transmission, wherein each of the components in the required electric transmission path must be a conductive body, and when any one of the components in the required electric transmission path is destructed, an electric current can no longer be transmitted. For example, when a fuse device is installed in the electric current path, then the fuse is a component in the required path of current transmission. A "required non-electric transmission path" points to the required path of non-electric transmission, wherein the components in the required non-electric transmission path can be conductive bodies or nonconductors.

In each of the embodiments of the present embodiment, in order to increase the electric conduction efficiency, a first silver contact point and a second silver contact point are installed between a conductive seesaw member and a second conductive member. However, if a first silver contact point and a second silver contact point are not installed, another feasible embodiment comprises enabling the conductive seesaw member to directly contact the second conductive member. In other words, the first silver contact point and the second silver contact point are not required components. In the following description, the conductive seesaw member in contact with or separated from the second conductive member implies and represents that the first silver contact point is in contact with or separated from the second silver contact point.

In the following description, "destruction" of an overheating destructive member or an awaiting destructive portion includes destructive methods such as loss of rigidity, softening, deformation, melting, gasification, fragmentation, decomposition, and charring.

Figure 1:
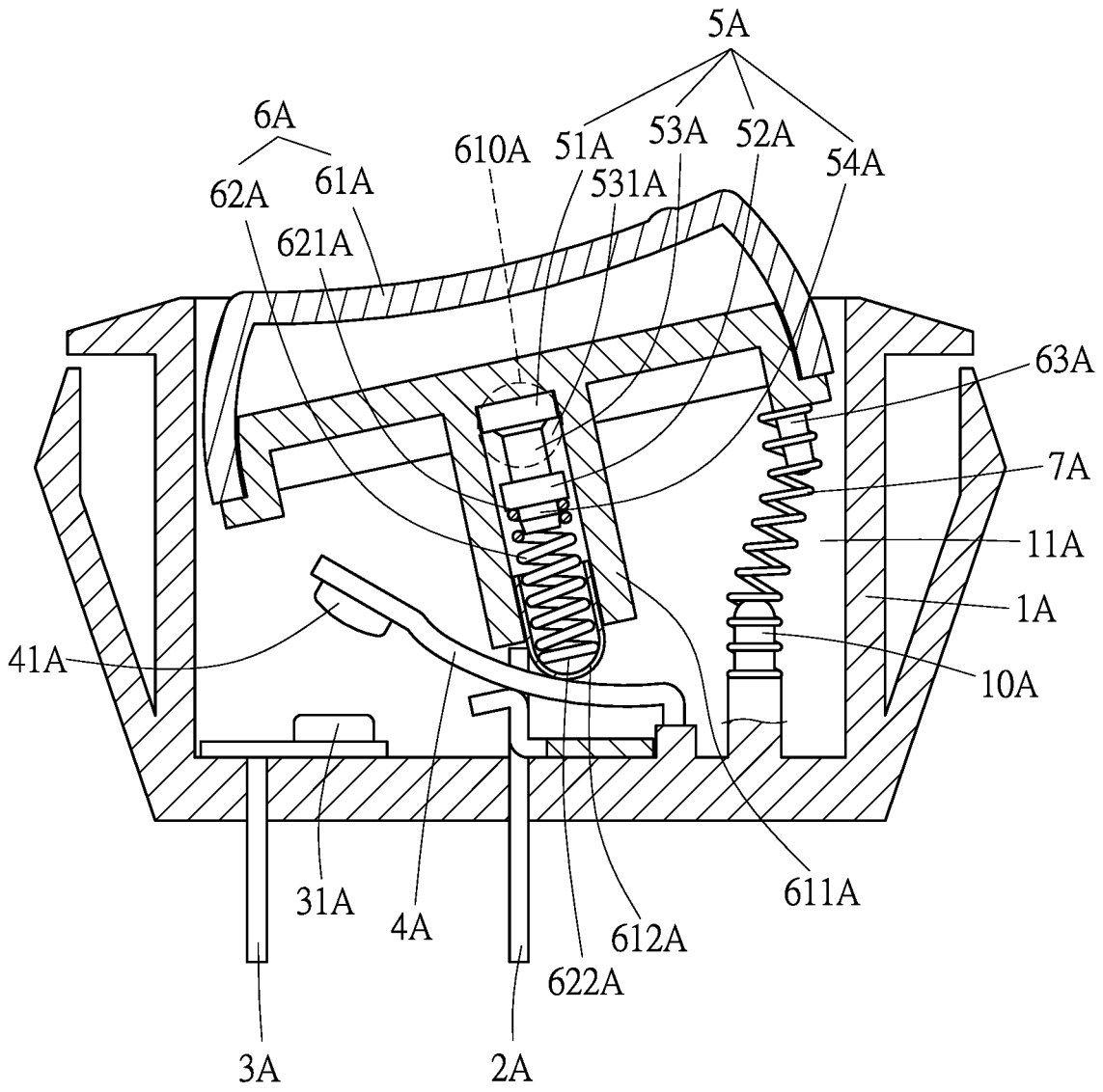
FIG. 1 is a schematic view of a first embodiment of the present invention, and shows a seesaw switch structure with the seesaw switch in a closed position.

Referring to FIG. 1, which shows a first embodiment of the present invention, wherein an overheating destructive switch is used to describe an overheating destructive method of the present invention. A seesaw switch is used in the present embodiment, and FIG. 1 depicts the seesaw switch in a closed state. The seesaw switch comprises:

A base (1A), which is provided with a holding space (11A); a first conductive member (2A) and a second conductive member (3A), both of which penetrate and are mounted on the base (1A); and a movable conductive member, which is mounted within the holding space (11A), and the movable conductive member is a conductive seesaw member (4A). The conductive seesaw member (4A) astrides and is mounted on the first conductive member (2A) and electrically connected thereto. When there is a temperature anomaly in the operating temperature resulting in a rise in temperature, it is preferred that a live wire triggers a circuit break; hence, the first conductive member (2A) in use is a live wire first end, the second conductive member (3A) in use is a live wire second end, and the conductive seesaw member (4A) is used to enable electrical conduction with the first conductive member (2A) and the second conductive member (3A) to form a live wire closed circuit. The conductive seesaw member (4A) is provided with a silver contact point (41A), and the second conductive member (3A) is correspondingly provided with a second silver contact point (31A). Accordingly, current is conducted between the aforementioned conductive seesaw member (4A) and the second conductive member (3A) using contact between the first silver contact point (41A) and the second silver contact point (31A). It is preferred that the first conductive member (2A), the second conductive member (3A), and the conductive seesaw member (4A) are made of copper material, and that the first silver contact point (41A) and the second silver contact point (31A) are made of silver material. When the seesaw switch is switched over to an open position, the first conductive member (2A), the conductive seesaw member (4A), the first silver contact point (41A), the second silver contact point (31A), and the second conductive member (3A) together form the "required electric transmission path".

An overheating destructive member (5A), which is destructed under a fail temperature condition, the fail temperature lying between 100° C. to 400° C. The overheating destructive member (5A) is positioned in the "required non-electric transmission path"; hence, insulating material such as plastic can be used, including thermoplastic plastic and thermoset plastic, or non-insulating material, including metal or alloy, such as an alloy comprising more than any two of the metals bismuth, cadmium, tin, lead, dysprosium, or indium; wherein a tin-bismuth alloy has a melting point around 138° C., and is a good material for detecting an overheating circuit. In the present embodiment, the overheating destructive member (5A) comprises a connecting portion (51A), an awaiting destructive portion (52A), a support portion (53A), and a mounting portion (54A). The support portion (53A) joins the connecting portion (51A) and the awaiting destructive portion (52A). A displacement space (531A) is defined around the axial periphery of the support portion (53A), that is, the diameter of the support portion (53A) is relatively smaller than that of the connecting portion (51A), thereby forming the displacement space (531A) around the support portion (53A). The awaiting destructive portion (52A) is mounted on the outer edge of the support portion (53A), and is not positioned within the displacement space (531A). The displacement space (531A) is the space reserved for the awaiting destructive portion (52A) and provides enough space for the awaiting destructive portion (52A) to displace therein after destruction thereof. The mounting portion (54A) is joined to the awaiting destructive portion (52A).

An operating component (6A), which is used to operate the conductive seesaw member (4A) to connect with the first conductive member (2A) and the second conductive member (3A) to form a live wire closed circuit or disconnect the circuit between the first conductive member (2A) and the second conductive member (3A), causing the live wire to form an open circuit. The operating component (6A) is assembled on the base (1A), and comprises an operating member (61A) and a first elastic member (62A). The operating member (61A) is provided with a pivot connecting point (610A) that is pivot connected to the base (1A), thereby enabling the operating member (61A) to use the pivot connecting point (610A) as an axis and limit back and forth rotation. The operating member (61A) further comprises a limiting member and a contact member (612A), wherein the limiting member is a retaining tubular portion (611A). The overheating destructive member (5A) is disposed within the retaining tubular portion (611A), and the first elastic member (62A) is also disposed inside the retaining tubular portion (611A), which enables one end (621A) of the first elastic member (62A) to be movably joined to the mounting portion (54A) of the overheating destructive member (5A) and butt against the awaiting destructive portion (52A). The contact member (612A) is a heat conducting member that is assembled in the retaining tubular portion (611A) and contacts the conductive seesaw member (4A). The other end (622A) of the first elastic member (62A) butts against the contact member (612A). The overheating destructive member (5A) is disposed at a position at a distance away from the conductive seesaw member (4A). Moreover, the first elastic member (62A) is compressed and confined between the contact member (612A) and the overheating destructive member (5A) and provided with a first elastic force. The contact member (612A), the first elastic member (62A), and the overheating destructive member (5A) are all positioned in the "required non-electric transmission path".

A second elastic member (7A), which, in the present embodiment, is a spring. The second elastic member (7A) is provided with a second elastic force that acts on the operating member (61A). The operating member (61A) is provided with a first protruding portion (63A) at a position away to one side of the pivot connecting point (610A), and the base (1A) is further provided with a second protruding portion (10A) at a position corresponding to the first protruding portion (63A). The two ends of the second elastic member (7A) are respectively mounted on the first protruding portion (63A) and the second protruding portion (10A).

Figure 2:
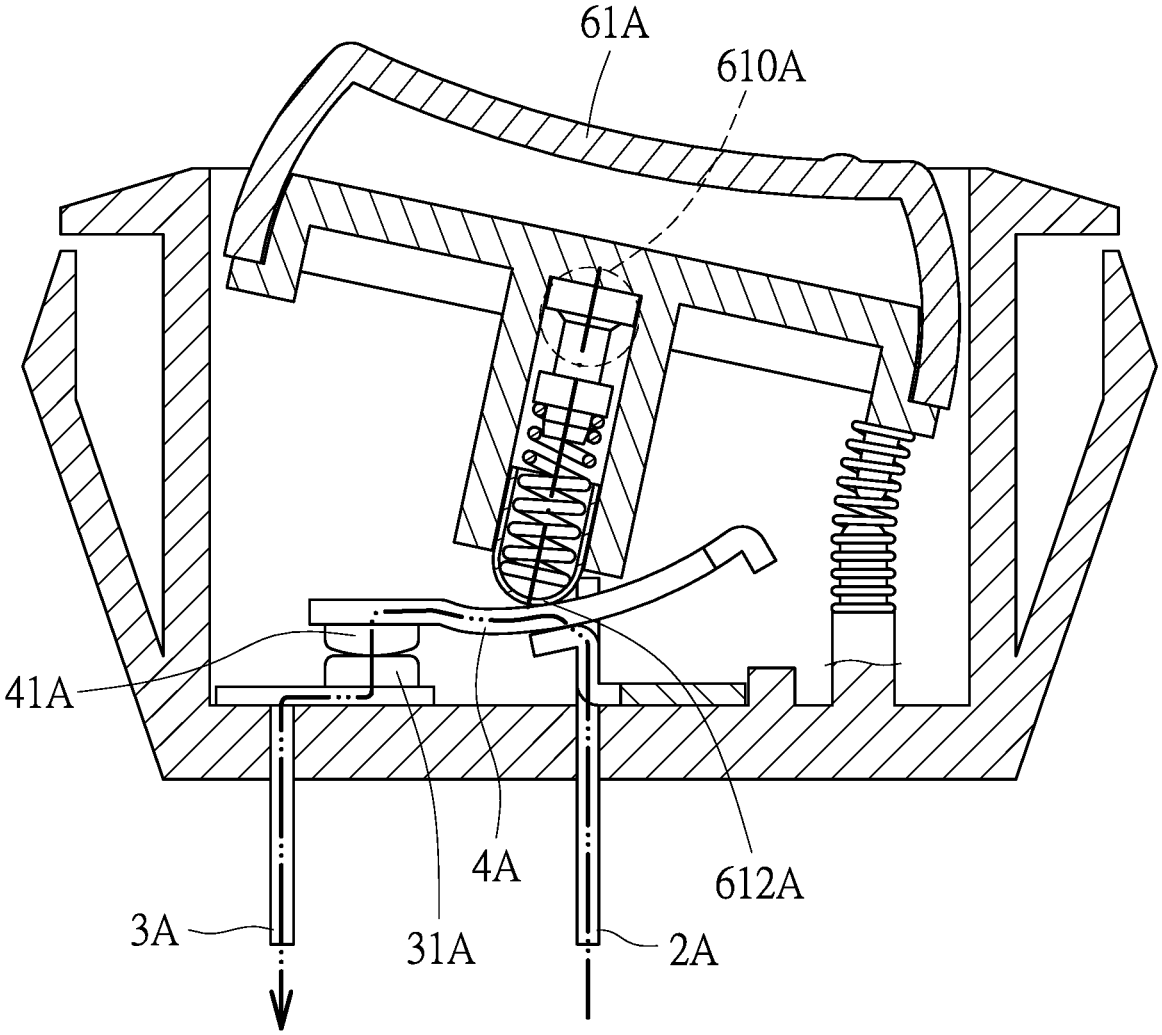
FIG. 2 is a schematic view of the first embodiment of the present invention, and shows the seesaw switch in an open position.

Referring to FIG. 2, a user toggles the operating member (61A) back and forth around the pivot connecting point (610A), which causes the contact member (612A) to slide on the conductive seesaw member (4A) and drive the conductive seesaw member (4A) in a seesaw movement to selectively contact or separate from the second conductive member (3A). When the contact member (612A) is slid on the conductive seesaw member (4A) in the direction of the first silver contact point (41A) on the conductive seesaw member (4A), the first elastic force forces the first silver contact point (41A) to contact the second silver contact point (31A), whereupon a power-on state is formed between the first conductive member (2A), the conductive seesaw member (4A), and the second conductive member (3A).

Figure 3:
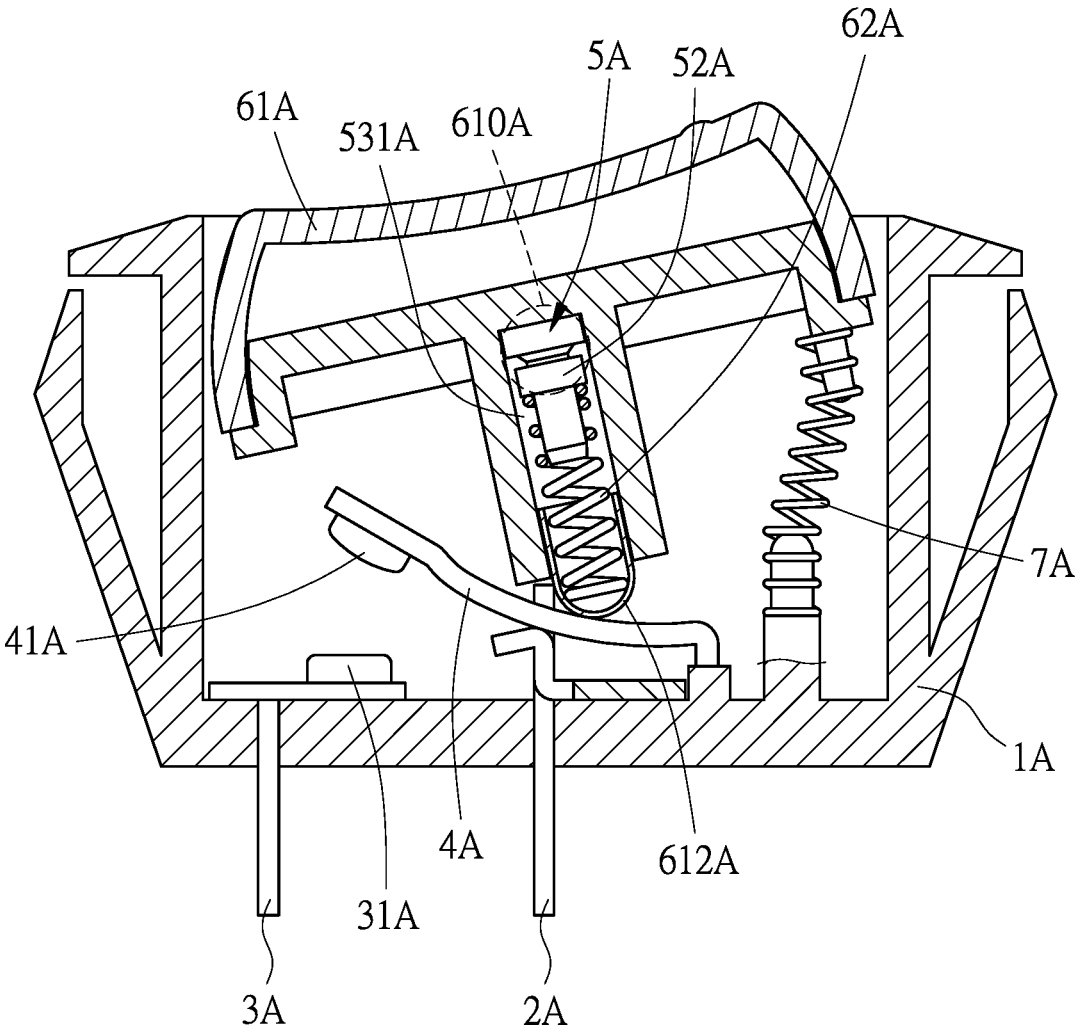
FIG. 3 is a schematic view of the first embodiment of the present invention, and shows, when an overheating destructive member is destructed due to overheating, a movable conductive member disconnected from a second conductive member, causing the seesaw switch to revert to a closed position from an open position to form an open circuit.

Referring to FIG. 3, when an abnormal condition occurs in an external electric equipment connected to the first conductive member (2A) or the second conductive member (3A), for example, the external electric equipment is a plug socket, oxides or dust present between the metal pins of a plug and the plug socket, or phenomena such as incomplete insertion of the metal pins or distorted metal pins will produce relatively large amounts of heat energy in the electrical conducting portions of the plug socket, at which time the heat energy is transferred to the conductive seesaw member (4A) through the first conductive member (2A) or the second conductive member (3A), and then successively through the contact member (612A) and the first elastic member (62A). Finally, the heat energy is transferred to the overheating destructive member (5A), at which point the awaiting destructive portion (52A) of the overheating destructive member (5A) absorbs the heat energy up to the fail temperature thereof, whereupon the awaiting destructive portion (52A) of the overheating destructive member (5A) is destructed and begins to gradually lose its rigidity, For example, if the material of the overheating destructive member (5A) is a tin-bismuth alloy, although the melting point thereof is 138° C., the tin-bismuth alloy begins to lose its rigidity when the temperature is close to its melting point, and under the concurrent effect of the first elastic force, the awaiting destructive portion (52A) of the overheating destructive member (5A) is pressed by the first elastic member (62A) and is gradually displaced toward the displacement space (531A), resulting in lessening or loss of the first elastic force, at which time the second elastic force is larger than the first elastic force. In the present embodiment, the arrangement of the first conductive member (2A) and the second conductive member (3A) is defined as being in a lengthwise direction. The operating member (61A) has a length in the lengthwise direction, and the first elastic member (62A) is disposed at the central position of the length. There is a distance between the disposed position of the second elastic member (7A) on the length and the central position; hence, when the second elastic force is larger than the first elastic force, a torque effect enables the operating member (61A) to rotate on the pivot connecting point (610A) as an axis, thereby driving the contact member (612A) to slide on the conductive seesaw member (4A) and forcing the operating member (61A) to displace and form a closed position. Accordingly, the first silver contact point (41A) of the conductive seesaw member (4A) separates from the second silver contact point (31A), that is, the conductive seesaw member (4A) disengages from the second conductive member (3A) to form a power-off state, thereby achieving the protective effect against overheating.

Referring again to FIG. 2, when the conductive seesaw member (4A) is connected to both the first conductive member (2A) and the second conductive member (3A), then the conductive seesaw member (4A), the first conductive member (2A), and the second conductive member (3A) are all positioned in the "required electric transmission path"; moreover, all three are made of copper material, which has a relatively small electric resistance, with a two-point chain line showing the "required electric transmission path" in FIG. 2. However, the contact member (612A), the first elastic member (62A), and the overheating destructive member (5A) are all positioned in the "required non-electric transmission path", with a one-point chain line showing the "required non-electric transmission path" in FIG. 2, wherein at least the first elastic member (62A) and the overheating destructive member (5A) are not made of copper material, and the electric resistance of the first elastic member (62A) and the overheating destructive member (5A) is greater than that of copper. Because electric current will flow toward the path of least electric resistance, thus, when the seesaw switch is in the state depicted in FIG. 2, the current follows the path of least electric resistance provided by the first conductive member (2A), the conductive seesaw member (4A), and the second conductive member (3A). Moreover, because the overheating destructive member (5A) and the first elastic member (62A) of the present invention are both positioned in the "required non-electric transmission path", thus, even if the electric resistance of the material of the overheating destructive member (5A) and the first elastic member (62A) is relatively large, there will be no wastage of energy. Hence, the disconnecting method of the present invention is completely different from the disconnecting method of traditional fuses, and is also completely different from the disconnecting method of an electric current overload switch with bimetallic strip.

Figure 4:
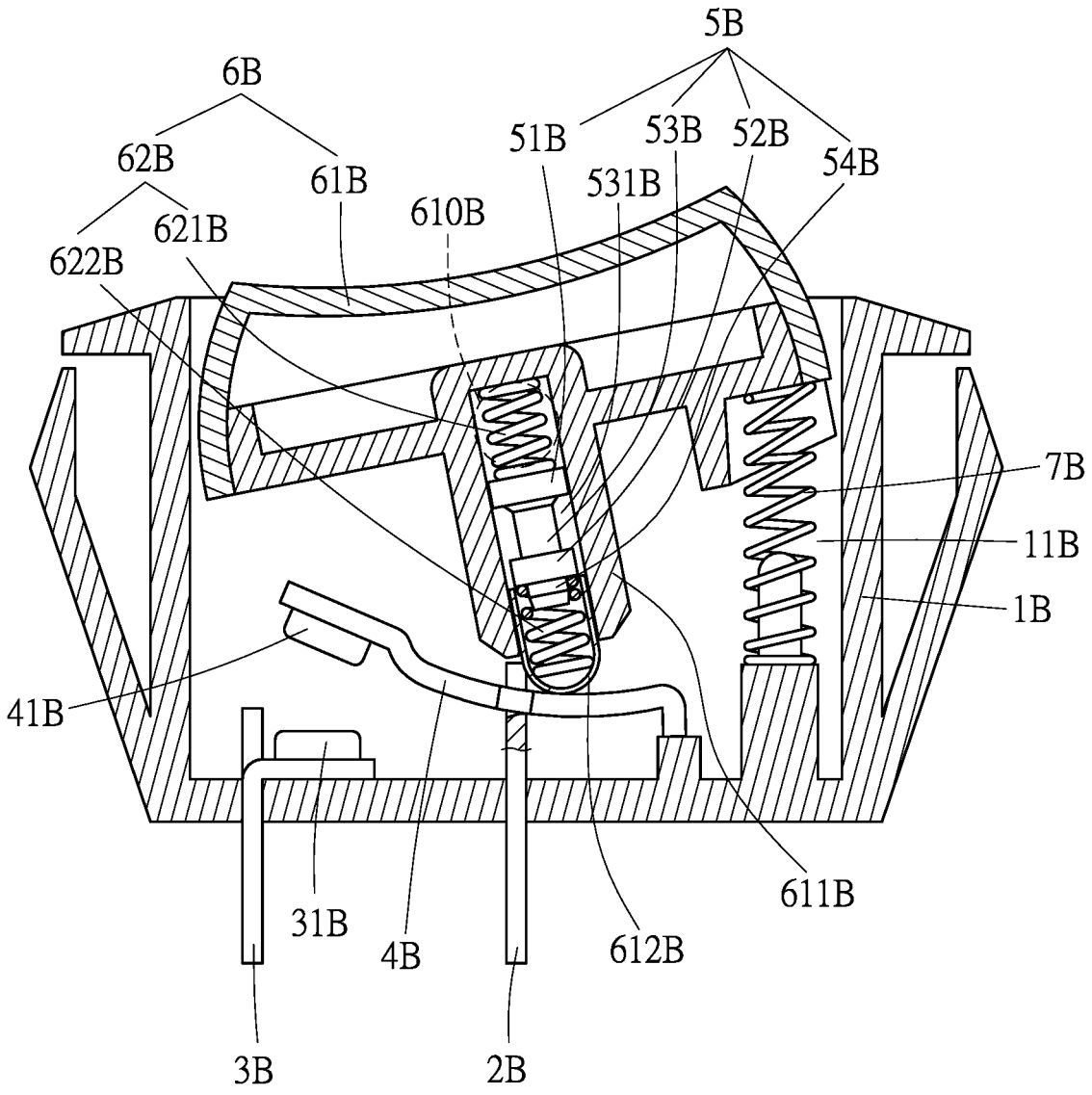
FIG. 4 is a schematic view of a second embodiment of the present invention, and shows another seesaw switch structure with the seesaw switch in a closed position.

Referring to FIG. 4, which shows a second embodiment of the present invention, wherein the present embodiment similarly uses an overheating destructive switch to describe an overheating destructive method of the present invention. The present embodiment similarly uses a seesaw switch, and FIG. 4 depicts the seesaw switch in a closed state. The seesaw switch comprises:

A base (1B), which is provided with a holding space (11B); a first conductive member (2B) and a second conductive member (3B), both of which penetrate and are mounted on the base (1B); and a movable conductive member, which is mounted within the holding space (11B). The movable conductive member is a conductive seesaw member (4B), which astrides and is mounted on the first conductive member (2B) and electrically connected thereto. When there is a temperature anomaly in the operating temperature resulting in a rise in temperature, it is preferred that a live wire triggers a circuit break, hence, the first conductive member (2B) in use is a live wire first end, the second conductive member (3B) in use is a live wire second end, and the conductive seesaw member (4B) is used to conduct current to the first conductive member (2B) and the second conductive member (3B) to form a live wire closed circuit. The conductive seesaw member (4B) is provided with a first silver contact point (41B) and the second conductive member (3B) is correspondingly provided with a second silver contact point (31B). An electric current is conducted between the above-described conductive seesaw member (4B) and the second conductive member (3B) using contact between the first silver contact point (41B) and the second silver contact point (31B). When the seesaw switch is switched over to an open position, the first conductive member (2B), the conductive seesaw member (4B), the first silver contact point (41B), the second silver contact point (31B), and the second conductive member (3B) together form the "required electric transmission path".

An overheating destructive member (5B), which is destructed under a fail temperature condition, the fail temperature lying between 100° C. to 400° C. The overheating destructive member (5B) is positioned in the "required non-electric transmission path"; therefore, insulating material such as plastic can be used, including thermoplastic plastic and thermoset plastic, or non-insulating material made of metal or an alloy, such as an alloy comprising more than any two of the metals bismuth, cadmium, tin, lead, dysprosium, or indium, wherein a tin-bismuth alloy has a melting point around 138° C., and is a good material for detecting an overheating circuit. In the present embodiment, the overheating destructive member (5B) comprises a connecting portion (51B), an awaiting destructive portion (52B), a support portion (53B), and a mounting portion (54B). The support portion (53B) joins the connecting portion (51B) and the awaiting destructive portion (52B). A displacement space (531B) is defined around the axial periphery of the support portion (53B), that is, the diameter of the support portion (53B) is relatively smaller than that of the connecting portion (51B), thereby forming the displacement space (531B) around the support portion (53B). The awaiting destructive portion (52B) is mounted on the outer edge of the support portion (53B), and is not positioned within the displacement space (531B). The displacement space (531B) is the space reserved for the awaiting destructive portion (52B) and provides enough space for the awaiting destructive portion (52B) to displace therein after destruction thereof. The mounting portion (54B) is joined to the awaiting destructive portion (52B).

An operating component (6B), which is used to operate the conductive seesaw member (4B) to connect with the first conductive member (2B) and the second conductive member (3B) to form a live wire closed circuit or disconnect the circuit between the first conductive member (2B) and the second conductive member (3B), causing the live wire to form an open circuit. The operating component (6B) is assembled on the base (1B) and comprises an operating member (61B) and a first elastic member (62B). The operating member (61B) is provided with a pivot connecting point (610B) that is pivot connected to the base (1B), thereby enabling the operating member (61B) to use the pivot connecting point (610B) as an axis and limit back and forth rotation. The operating member (61B) further comprises a contact member (612B) and a limiting member. The contact member (612B) is a hollow shaped heat conducting member that contacts the conductive seesaw member (4B), and the limiting member is a retaining tubular portion (611B). The first elastic member (62B) comprises a first spring (621B) and a second spring (622B), wherein the first spring (621B), the second spring (622B), and the overheating destructive member (5B) are disposed within the retaining tubular portion (611B). The second spring (622B) butts against the contact member (612B), and the overheating destructive member (5B) is disposed between the first spring (621B) and the second spring (622B). Accordingly, the overheating destructive member (5B) is disposed at a position distance away from the conductive seesaw member (4B) by means of the first spring (621B). The first spring (621B) and the second spring (622B) are thus compressed and respectively provided with an elastic force. The total combined elastic force of the first spring (621B) and the second spring (622B) provides a first elastic force.

A second elastic member (7B), which, in the present embodiment, is a spring. The second elastic member (7B) is provided with a second elastic force that acts on the operating member (61B).

Figure 5:
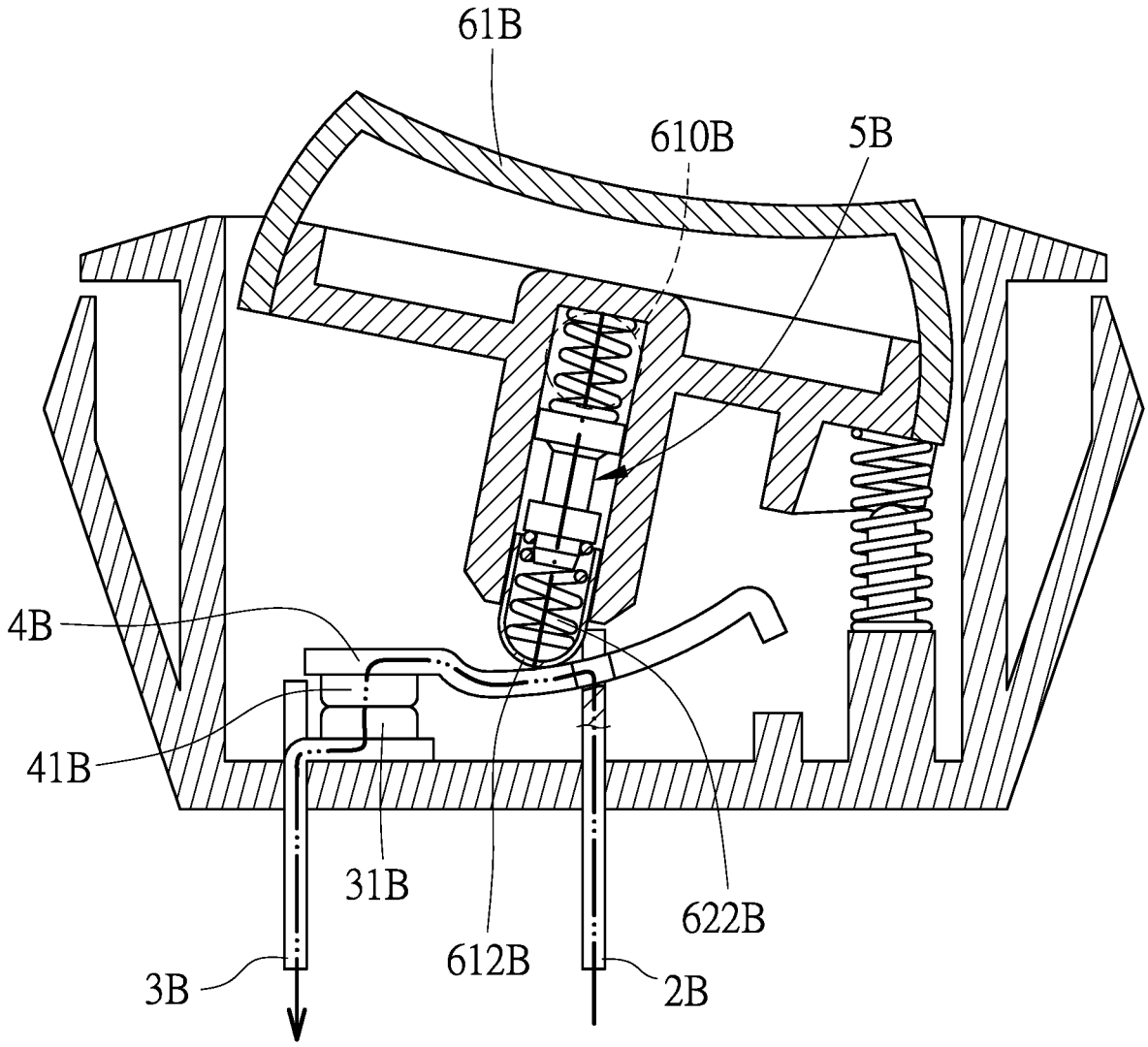
FIG. 5 is a schematic view of the second embodiment of the present invention, and shows the seesaw switch in an open position.

Referring to FIG. 5, a user toggles the operating member (61B) back and forth around the pivot connecting point (610B), which causes the contact member (612B) to slide on the conductive seesaw member (4B), thereby enabling the conductive seesaw member (4B) to selectively contact or separate from the second conductive member (3B) in a seesaw movement. When the contact member (612B) is slid on the conductive seesaw member (4B) in the direction of the first silver contact point (41B) on the conductive seesaw member (4B), the first elastic force forces the first silver contact point (41B) to contact the second silver contact point (31B) on the second conductive member (3B), enabling the first conductive member (2B), the conductive seesaw member (4B), and the second conductive member (3B) to form a current-carrying path.

Figure 6:
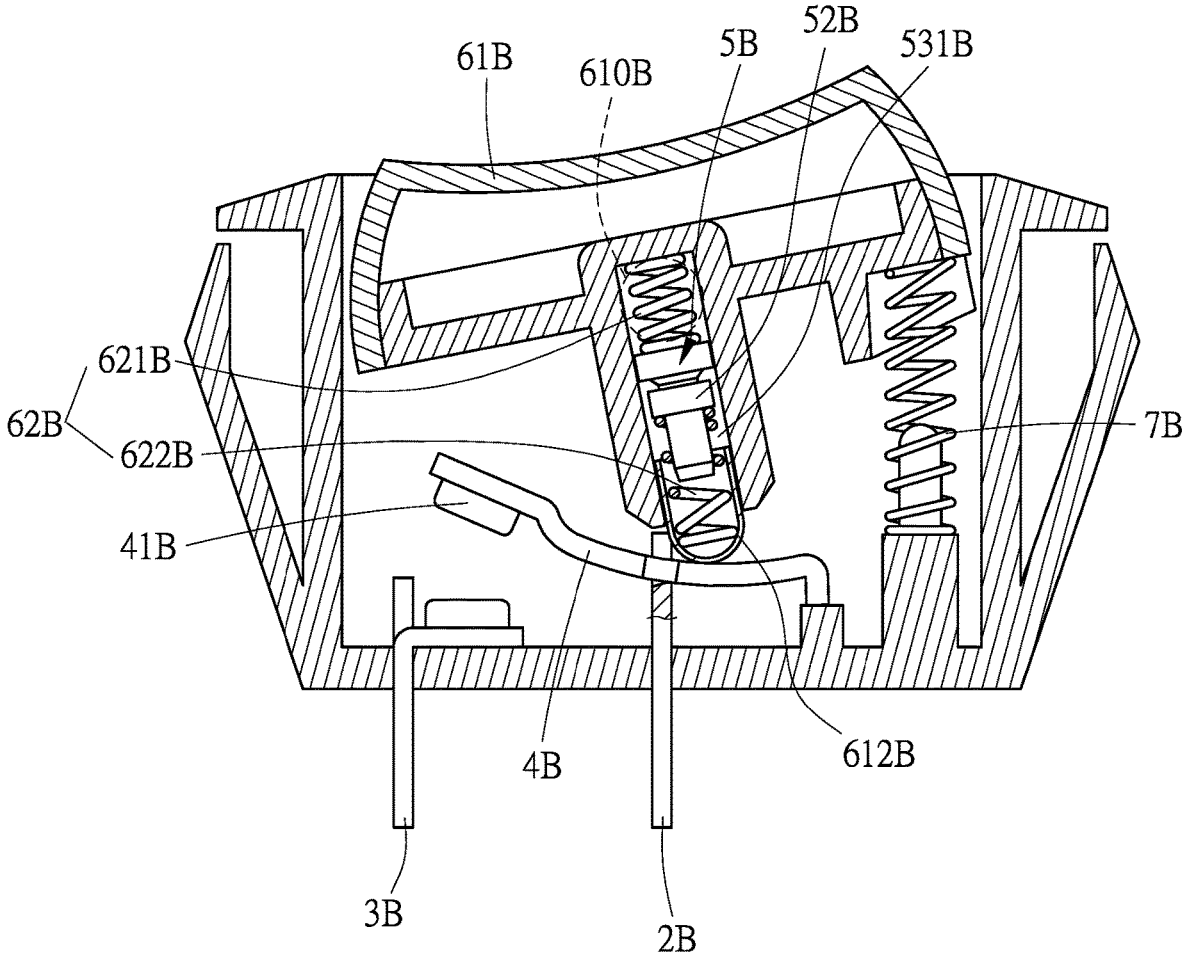
FIG. 6 is a schematic view of the second embodiment of the present invention, and shows, when an overheating destructive member is destructed due to overheating, a movable conductive member disconnected from a second conductive member, causing the seesaw switch to revert to a closed position from an open position.

Referring to FIG. 6, when an abnormal condition occurs in an external electric equipment connected to the first conductive member (2B) or the second conductive member (3B), for example, the external electric equipment is a plug socket, oxides or dust present between the metal pins of a plug and the plug socket, or phenomena such as incomplete insertion of the metal pins or distorted metal pins will produce relatively large amounts of heat energy in the electrical conducting portions of the plug socket, whereupon the heat energy is transferred to the conductive seesaw member (4B) through the first conductive member (2B) or the second conductive member (3B), and then transferred to the overheating destructive member (5B) through the contact member (612B) and the second spring (622B). The awaiting destructive portion (52B) of the overheating destructive member (5B) gradually absorbs the heat energy up to the fail temperature thereof, at which time the awaiting destructive portion (52B) of the overheating destructive member (5B) is destructed and begins to gradually lose its rigidity For example, if the material of the overheating destructive member (5B) is a tin-bismuth alloy, although the melting point thereof is 138° C., the tin-bismuth alloy begins to lose its rigidity when the temperature is close to its melting point, and under the concurrent effect of the first elastic force, the awaiting destructive portion (52B) of the overheating destructive member (5B) is compressed by the first spring (621B) and the second spring (622B), and is gradually displaced toward the displacement space (531B), resulting in lessening or loss of the first elastic force, at which point the second elastic force is larger than the first elastic force. In the present embodiment, the arrangement of the first conductive member (2B) and the second conductive member (3B) is defined as being in a lengthwise direction. The operating member (61B) has a length in the lengthwise direction, and the first elastic member (62B) is disposed at the central position of the length. There is a distance between the disposed position of the second elastic member (7B) and the central position; hence, when the second elastic force is larger than the first elastic force, a torque effect forces the operating member (61B) to rotate on the pivot connecting point (610B) as an axis, thereby driving the contact member (612B) to slide on the conductive seesaw member (4B) and forcing the operating member (61B) to displace and form a closed position. Accordingly, the first silver contact point (41B) of the conductive seesaw member (4B) separates from the second conductive member (3B) to form a power-off state, thereby achieving the protective effect against overheating.

Referring to FIG. 5, when the conductive seesaw member (4B) is connected to both the first conductive member (2B) and the second conductive member (3B), then the conductive seesaw member (4B), the first conductive member (2B), and the second conductive member (3B) are all positioned in the "required electric transmission path"; moreover, all three are made of copper material, which has a relatively small electric resistance, with a two-point chain line showing the "required electric transmission path" in FIG. 5. However, the contact member (612B), the second spring (622B), and the overheating destructive member (5B) are all positioned in the "required non-electric transmission path", with a one-point chain line showing the "required non-electric transmission path" in FIG. 5, wherein at least the second spring (622B) and the overheating destructive member (5B) are not made of copper material, hence the electric resistance of the second spring (622B) and the overheating destructive member (5B) is greater than that of copper. Because electric current will flow toward the path of least electric resistance, thus, when the seesaw switch is in the state depicted in FIG. 5, the electric current follows the path of least electric resistance provided by the first conductive member (2B), the conductive seesaw member (4B), and the second conductive member (3B). Because the overheating destructive member (5B) and the second spring (622B) of the present embodiment are both positioned in the "required non-electric transmission path", thus, even if the electric resistance of the material of the overheating destructive member (5B) and the second spring (622B) is relatively large, there will be no wastage of energy. Hence, the disconnecting method of the present invention is completely different from the disconnecting method of traditional fuses, and is also completely different from the disconnecting method of an electric current overload switch with bimetallic strip.

Figure 7:
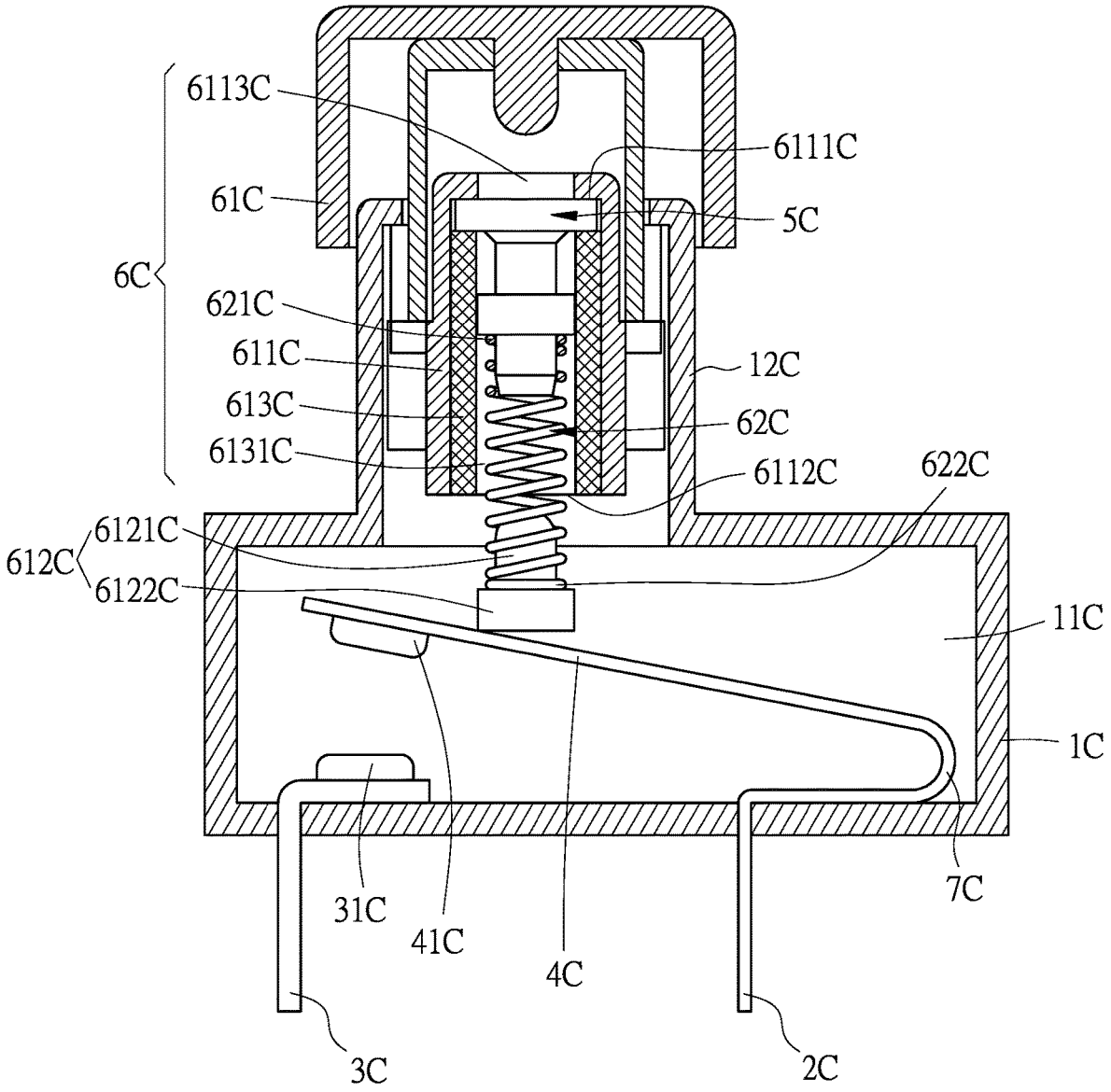
FIG. 7 is a schematic view of a third embodiment of the present invention, and shows a press switch structure with the press switch in a closed position.

Referring to FIG. 7, which shows a third embodiment of the present invention, wherein the present embodiment similarly uses an overheating destructive switch to describe an overheating destructive method of the present invention. The present embodiment uses a press switch, and FIG. 7 shows the press switch in a closed state. The press switch comprises:

A base (1C), which is provided with a holding space (11C) and a protruding portion (12C); a first conductive member (2C) and a second conductive member (3C), both of which penetrate and are mounted on the base (1C); and a movable conductive member, which is mounted within the holding space (11C), and the movable conductive member is a conductive cantilever member (4C). When there is a temperature anomaly in the operating temperature resulting in a rise in temperature, it is preferred that a live wire triggers a circuit break, hence, the first conductive member (2C) in use is a live wire first end, the second conductive member (3C) in use is a live wire second end, whereby the conductive cantilever member (4C) is used to enable electrical conduction with the first conductive member (2C) and the second conductive member (3C) to form a live wire closed circuit. The conductive cantilever member (4C) is provided with a first silver contact point (41C), and the second conductive member (3C) is correspondingly provided with a second silver contact point (31C). An electric current is conducted between the above-described conductive seesaw member (4C) and the second conductive member (3C) using contact between the first silver contact point (41C) and the second silver contact point (31C). When the press switch is switched to an open position, the first conductive member (2C), the conductive cantilever member (4C), the first silver contact point (41C), the second silver contact point (31C), and the second conductive member (3C) together form the "required electric transmission path".

An overheating destructive member (5C), which is destructed under a fail temperature condition, the fail temperature lying between 100° C. to 400° C. The overheating destructive member (5C) is positioned in the "required non-electric transmission path", thus, insulating material such as plastic including thermoplastic plastic and thermoset plastic can be used, or non-insulating material made of metal or an alloy, such as an alloy comprising more than any two of the metals bismuth, cadmium, tin, lead, dysprosium, or indium, wherein a tin-bismuth alloy has a melting point around 138° C., is a good material for detecting an overheating circuit. The form of the overheating destructive member (5C) is the same as the first embodiment and the second embodiment described above, The press switch of the present embodiment is further provided with an operating component (6C), which is used to operate the conductive cantilever member (4C) to connect with the first conductive member (2C) and the second conductive member (3C) to form a live wire closed circuit or disconnect the circuit between the first conductive member (2C) and the second conductive member (3C), causing the live wire to form an open circuit. The operating component (6C) is assembled on the base (1C) and comprises an operating member (61C) and a first elastic member (62C). The operating member (61C) is assembled on the protruding portion (12C) and has limited up and down displacement on the protruding portion (12C). The up and down displacement and positioning structure of the entire operating component (6C) is the same as the press button structure of an automatic ball-point pen of the prior art, such as the prior art structure of a "Push-button Switch" disclosed in China Patent No. CN103441019. Hence, the drawings of the present embodiment omit illustrating a number of structural positions disclosed in the prior art. The operating member (61C) further comprises a retaining portion (611C), a contact member (612C), and a limiting member (613C). An end of the retaining tubular portion (611C) is provided with an assembly position (6111C) at a distance away from the conductive cantilever member (4C). The other end of the retaining tubular portion (611C) close to the conductive cantilever member (4C) is provided with an opening (6112C). The end of the retaining tubular portion (611C) is further provided with a through hole (6113C) at a distance away from the conductive cantilever member (4C). The overheating destructive member (5C) is disposed in the retaining tubular portion (611C) through the opening (6112C), causing the overheating destructive member (5C) to butt against the assembly position (6111C). The limiting member (613C) is a cylinder body that defines a space (6131C). The limiting member (613C) is used to butt against the overheating destructive member (5C), which is thus caused to position of the overheating destructive member (5C) at the assembly position (6111C) of the retaining tubular portion (611C). The first elastic member (62C) is disposed within the space (6131C), causing a first end (621C) of the first elastic member (62C) to butt against the overheating destructive member (5C). The contact member (612C) comprises a limiting post (6121C) and a supporting base (6122C). The limiting post (6121C) extends into a second end (622C) of the first elastic member (62C), causing the first elastic member (62C) to butt against the supporting base (6122C). The supporting base (6122C) also contacts the conductive cantilever member (4C), and the overheating destructive member (5C) butts against the limiting member (613C). The first elastic member (62C) is compressed and confined between the contact member (612C) and the overheating destructive member (5C) and provided with a first elastic force.

The press switch of the present embodiment is further provided with a second elastic member, which is a spring plate (7C), and the first conductive member (2C), the spring plate (7C) and the conductive cantilever member (4C) are formed as an integral body. The spring plate (7C) is provided with a second elastic force that acts on the conductive cantilever member (4C).

Figure 8:
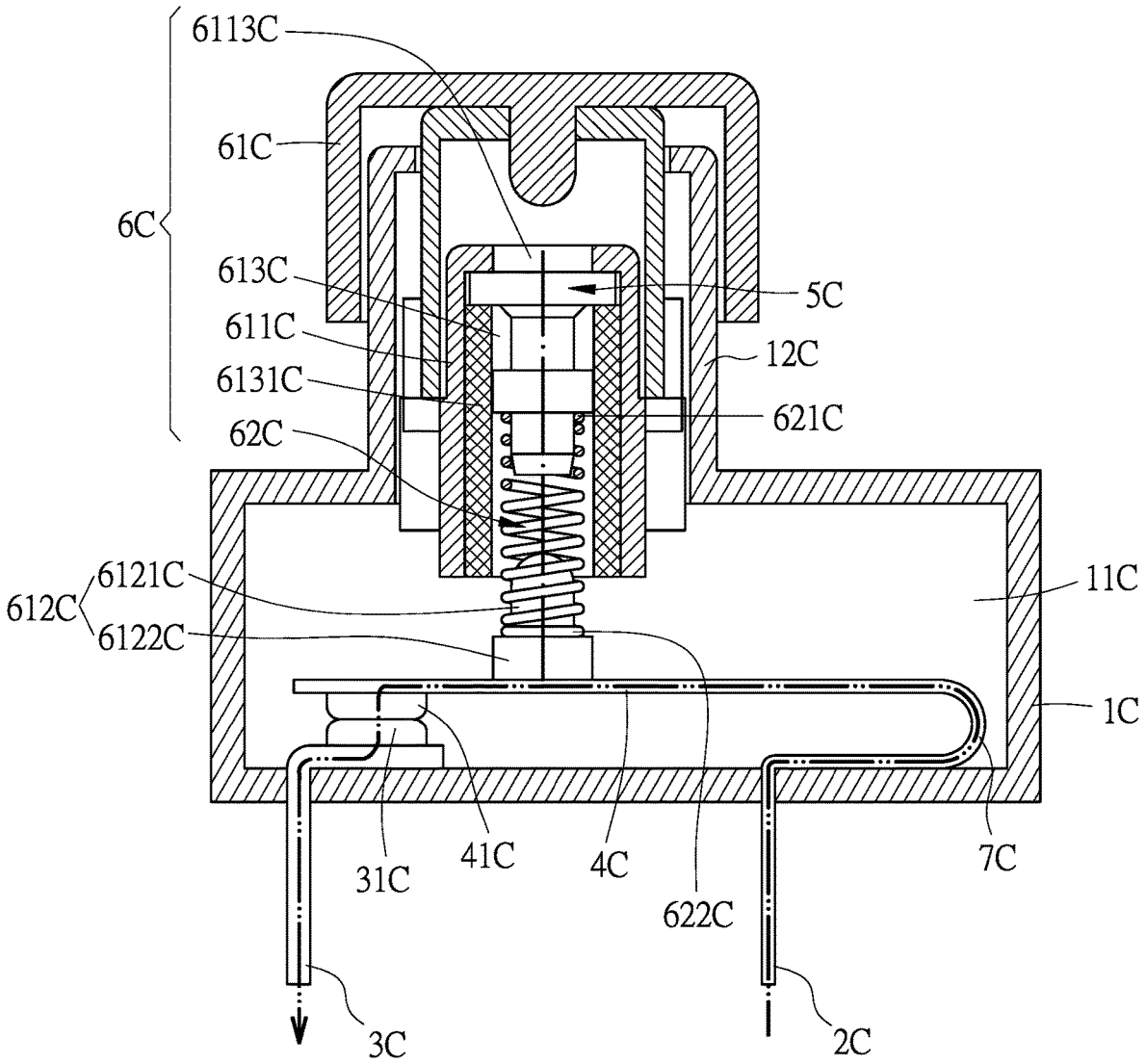
FIG. 8 is schematic view of the third embodiment of the present invention, and shows the press switch in an open position.

Referring to FIG. 8, a user displaces the operating member (61C) relative to the protruding portion (12C), just like pressing the button on an automatic ball-point pen, which causes the conductive cantilever member (4C) to selectively contact or separate from the second conductive member (3C). When the operating member (61C) is displaced in the direction of the conductive cantilever member (4C) and positioned, the supporting base (6122C) of the contact member (612C) presses against the conductive cantilever member (4C), which causes the first silver contact point (41C) to contact the second silver contact point (31C), that is, the conductive cantilever member (4C) contacts the second conductive member (3C) and forms a power-on state; at the same time the first elastic member (62C) is further compressed, enlarging the first elastic force, at which time the first elastic force is larger than the second elastic force.

Figure 9:
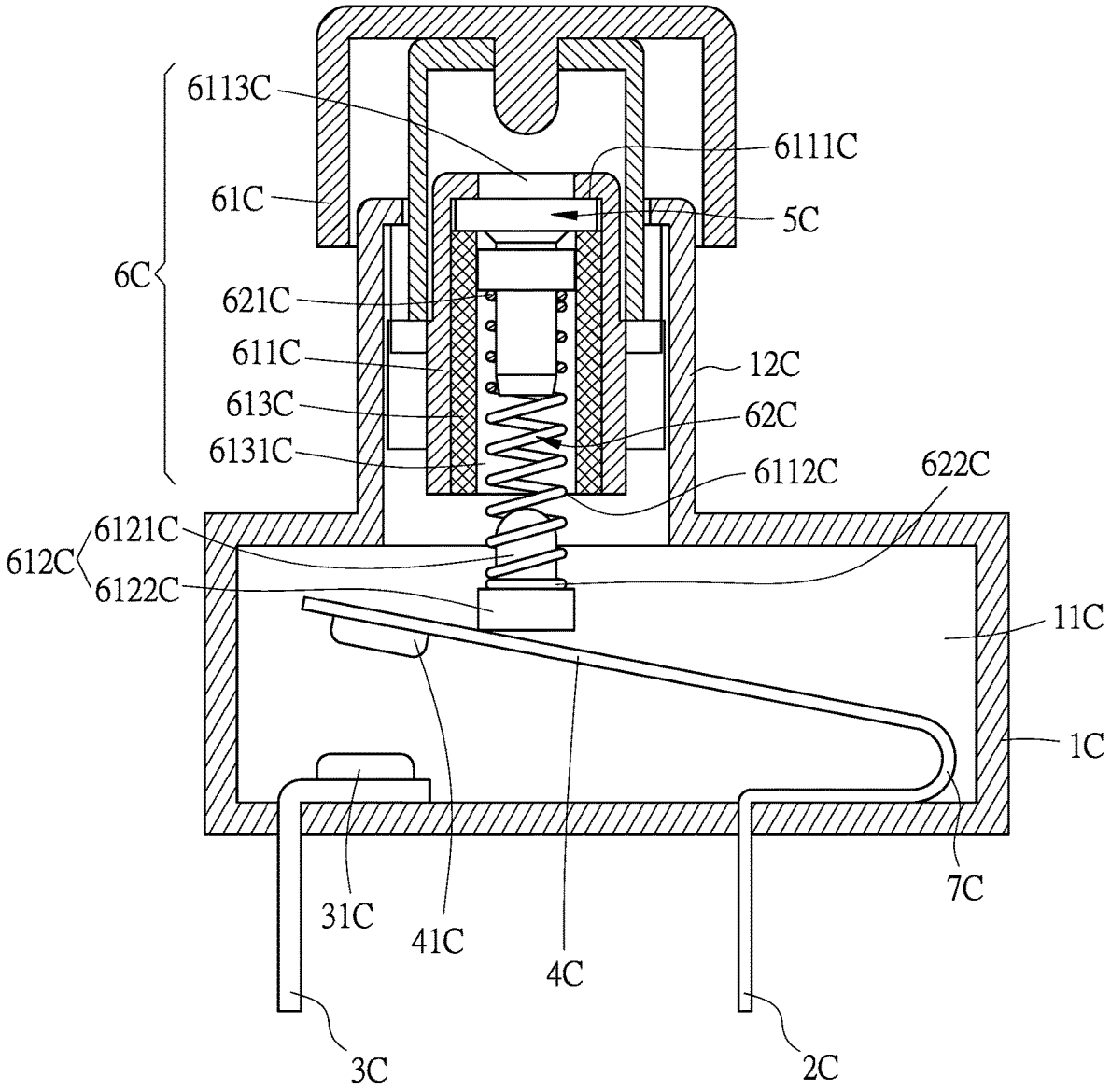
FIG. 9 is a schematic view of the third embodiment of the present invention, and shows, when an overheating destructive member is destructed due to overheating, a movable conductive member disconnected from a second conductive member, causing the press switch to revert to a closed position from an open position.

Referring to FIG. 9, when an abnormal condition occurs in an external electric equipment connected to the first conductive member (2C) or the second conductive member (3C), for example, the external electric equipment is a plug socket, oxides or dust present between the metal pins of a plug and the plug socket, or incomplete insertion or distortion of the metal pins will produce relatively large amounts of heat energy in the electrical conducting portions of the plug socket, whereupon, the heat energy is transferred to the conductive cantilever member (4C) through the first conductive member (2C) or the second conductive 10*o* member (3C), and then transferred to the overheating destructive member (5C) through the contact member (612C) and the first elastic member (62C). The overheating destructive member (5C) gradually absorbs the heat energy up to the fail temperature thereof, at which time the overheating destructive member (5C) begins to gradually lose its rigidity. For example, if the material of the overheating destructive member (5C) is a tin-bismuth alloy, although the melting point thereof is 138° C., the tin-bismuth alloy begins to lose its rigidity when the temperature is close to its melting point, and under the concurrent effect of the first elastic force, the overheating destructive member (5C) is pressed and deformed by the first elastic member (62C) to the extent of being destructed and is no longer able to restrain the first elastic member (62C), resulting in lessening or loss of the first elastic force, whereupon the second elastic force is larger than the first elastic force and forces the conductive cantilever member (4C) to reposition, thereby causing the first silver contact point (41C) of the conductive cantilever member (4C) to separate from the second silver contact point (31C) of the second conductive member (3C) and form a power-off state, thereby achieving the protective effect against overheating.

Referring again to FIG. 8, when the conductive cantilever member (4C) is connected to both the first conductive member (2C) and the second conductive member (3C), then the conductive cantilever member (4C), the first conductive member (2C), and the second conductive member (3C) are all positioned in the "required electric transmission path"; moreover, all three are made of copper material, with has a relatively small electric resistance, with a two-point chain line showing the "required electric transmission path" in FIG. 8. However, the contact member (612C), the first elastic member (62C), and the overheating destructive member (5C) are all positioned in the "required non-electric transmission path", with a one-point chain line showing the "required non-electric transmission path" in FIG. 8, wherein at least the first elastic member (62C) and the overheating destructive member (5C) are not made of copper material, hence the electric resistance of the first elastic member (62C) and the overheating destructive member (5C) is greater than that of copper. Because electric current will flow toward the path of least electric resistance, thus, when the press switch is in the state depicted in FIG. 8, the electric current follows the path of least electric resistance provided by the first conductive member (2C), the conductive cantilever member (4C), and the second conductive member (3C). Because the overheating destructive member (5C) and the first elastic member (62C) of the present invention are both positioned in the "required non-electric transmission path", thus, even if the electric resistance of the material of the overheating destructive member (5C) and the first elastic member (62C) is relatively large, there will be no wastage of energy. Hence, the disconnecting method of the present invention is completely different from the disconnecting method of traditional fuses, and is also completely different from the disconnecting method of an electric current overload switch with bimetallic strip.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An overheating destructive disconnecting method for switch, comprising the following steps:

enabling a first elastic force of a first elastic member to concurrently apply a force to an overheating destructive member and a movable conductive member through an operating member, whereby a force application direction of the first elastic force causes the movable conductive member to concurrently contact a first conductive member and a second conductive member to form a conductive circuit;

enabling a second elastic force of a second elastic member to act on the movable conductive member through the operating member, whereby a force application direction of the second elastic force causes the movable conductive member to separate away from the first conductive member or the second conductive member;

when the movable conductive member is concurrently in contact with the first conductive member and the second conductive member, enabling the overheating destructive member to be positioned in a required non-electric transmission path, and for the overheating destructive member to be disposed at a position away from the movable conductive member; accordingly the overheating destructive member which is positioned in the required non-electric transmission path is able to receive heat energy from a current-carrying circuit;

enabling the heat energy in the current-carrying circuit to be successively transferred through the movable conductive member and the first elastic member to the overheating destructive member;

when the overheating destructive member receives the heat energy and rises in temperature close to its fail temperature, the force application of the first elastic force is used to destruct or deform the overheating destructive member, causing deformation of the first elastic member, which results in the first elastic force acting on the movable conductive member being lessened or lost, whereupon the second elastic force presses and forces the movable conductive member to move position, causing the movable conductive member to no longer concurrently conduct electricity to the first conductive member and the second conductive member, and thus breaking the current-carrying circuit.

2. The overheating destructive disconnecting method for switch according to claim 1, wherein the fail temperature of the overheating destructive member lies between 100° C. to 400° C.

3. The overheating destructive disconnecting method for switch according to claim 2, wherein the overheating destructive member is made of plastic material.

4. The overheating destructive disconnecting method for switch according to claim 2, wherein the overheating destructive member is made of metal or an alloy.

5. The overheating destructive disconnecting method for switch according to claim 4, wherein the primary composition of the alloy comprises more than any two of the metals bismuth, cadmium, tin, lead, dysprosium, or indium.

6. The overheating destructive disconnecting method for switch according to claim 4, wherein the alloy is a tin-bismuth alloy, or one of or a combination of cadmium, indium, silver, tin, lead, antimony, or copper are additionally added to the tin-bismuth alloy.

* * * * *